US006221436B1

(12) United States Patent
Perry et al.

(10) Patent No.: US 6,221,436 B1
(45) Date of Patent: Apr. 24, 2001

(54) COATING METHOD INVOLVING SUBSTRATE CLEANING

(75) Inventors: Philip G. Perry, Webster; Gene W. O'Dell; William G. Herbert, both of Williamson, all of NY (US)

(73) Assignee: Xerox Corporation, Stamford, CT (US)

( * ) Notice: Subject to any disclaimer, the term of this patent is extended or adjusted under 35 U.S.C. 154(b) by 799 days.

(21) Appl. No.: 08/517,512

(22) Filed: Aug. 21, 1995

(51) Int. Cl.[7] ..... B05D 1/18

(52) U.S. Cl. ..... 427/430.1; 427/299; 134/3; 134/26; 430/56

(58) Field of Search ..... 427/430.1, 348, 427/299, 327; 118/423, 425, 72, 73; 134/2, 3, 26, 41, 22.14; 430/56, 58, 66, 67, 96

(56) References Cited

U.S. PATENT DOCUMENTS 4,652,507 3/1987 Dössel et al. .
5,186,477 * 2/1993 Nakazawa et al. ..... 279/2.09
5,213,937 5/1993 Miyake .
5,334,246 8/1994 Pietrzykowski, Jr. et al. .
5,561,015 * 10/1996 Yoshida et al. ..... 430/58

* cited by examiner

*Primary Examiner*—Shrive Beck
*Assistant Examiner*—Bret B. Chen
(74) *Attorney, Agent, or Firm*—Zosan S. Soong

(57) ABSTRACT

There is disclosed a method for depositing layered material onto a substrate including a layer formed from a coating solution, wherein the method comprises: (a) cleaning the substrate by dipping the substrate into and raising the substrate from a cleaning solvent selected from the group consisting of (i) a mixture comprising an alcohol and an alkane; and (ii) a liquid compatible with the coating solution; and (b) dipping the substrate subsequent to (a) into and raising the substrate from the coating solution, thereby depositing the layer on the substrate, wherein when the cleaning solvent is the liquid compatible with the coating solution, any cleaning solvent present on the substrate upon the dipping of the substrate into the coating solution fails to detrimentally affect the layer.

8 Claims, No Drawings

COATING METHOD INVOLVING SUBSTRATE CLEANING

This invention relates generally to a method for coating a substrate with layered material to fabricate for example a photoreceptor for use in an electrostatographic printing apparatus. In particular, the present invention pertains to a coating method involving a substrate cleaning operation and at least one dip coating step.

Dip coating is a coating method involving dipping a substrate in a coating solution and taking up the substrate. In dip coating, the coating thickness depends on the concentration of the coating material and the take-up speed, i.e., the speed of the substrate being lifted from the surface of the coating solution. It is known that the coating thickness generally increases with the coating material concentration and with the take-up speed.

The substrate is generally cleaned prior to dip coating since the substrate may have surface contaminants such as dust, fingerprints, and residual cutting fluids which can cause coating defects. There is a need, which the present invention addresses, for substrate cleaning solvents which are preferably environmentally friendly (e.g., avoiding if possible the use of halogenated solvents), and wherein the substrate cleaning operation can be readily added to the substrate coating line.

The following documents disclose conventional dip coating methods, dip coating apparatus, and photosensitive members: Miyake, U.S. Pat. No. 5,213,937; Dossel et al., U.S. Pat. No. 4,652,507; and Pietrzykowski, Jr. et al., U.S. Pat. No. 5,334,246, the disclosures of which are totally incorporated by reference. In particular, Miyake, U.S. Pat. No. 5,213,937, discloses washing the substrate with a solvent such as dichloroethylene, trichloroethylene, and chloroform (col. 3, lines 17–22).

SUMMARY OF THE INVENTION

The present invention is accomplished in embodiments by providing a method for depositing layered material onto a substrate including a layer formed from a coating solution, wherein the method comprises:

(a) cleaning the substrate by dipping the substrate into and raising the substrate from a cleaning solvent selected from the group consisting of (i) a mixture comprising an alcohol and an alkane; and (ii) a liquid compatible with the coating solution; and (b) dipping the substrate subsequent to (a) into and raising the substrate from the coating solution, thereby depositing the layer on the substrate, wherein when the cleaning solvent is the liquid compatible with the coating solution, any cleaning solvent present on the substrate upon the dipping of the substrate into the coating solution fails to detrimentally affect the layer.

There is also provided in embodiments a method for depositing layered material onto a substrate including a layer formed from a coating solution, wherein the method comprises:

(a) cleaning the substrate by dipping the substrate into and raising the substrate from a cleaning solvent comprising an alcohol and an alkane; and (b) dipping the substrate subsequent to (a) into and raising the substrate from the coating solution, thereby depositing the layer on the substrate, wherein the layer is a charge blocking layer or a photosensitive layer of a photoreceptor.

There is further provided in embodiments a method for depositing layered material onto a substrate including a layer formed from a coating solution having a coating solvent, wherein the method comprises:

(a) cleaning the substrate by dipping the substrate into and raising the substrate from a cleaning solvent compatible with the coating solution; and (b) dipping the substrate subsequent to (a) into and raising the substrate from the coating solution, thereby depositing the layer on the substrate, wherein the layer is a charge blocking layer or a photosensitive layer of a photoreceptor, wherein any cleaning solvent present on the substrate upon the dipping of the substrate into the coating solution fails to detrimentally affect the layer.

DETAILED DESCRIPTION

In embodiments of the present invention, the substrate is cleaned prior to dip coating by dipping the substrate into and raising the substrate from a cleaning solvent consisting only of an alcohol and an alkane. The alcohol and alkane are present in the following amounts (by weight based on the total weight of the two components): alcohol, from about 50% to about 90%, and preferably from about 60% to about 80%, and especially about 70%; and alkane, from about 10% to about 50%, from about 20% to about 40%, and especially about 30%.

Suitable alcohols include compounds having one, two, or more —OH groups. Preferred alcohols include for example: aliphatic alcohols such as methanol, ethanol, isopropanol, n-butanol, ally alcohol; alicyclic alcohols such as cyclohexanol; aromatic alcohols such as as phenol and benzyl alcohol; and heterocyclic alcohols such as furfuryl alcohol. Especially preferred alcohols contain a single —OH group and have one to six carbon atoms such as the paraffinic alcohols.

Suitable alkanes are those having boiling points between about 25 to about 100 degrees Centigrade which include for example isopentane, n-pentane, 2,2-dimethylbutane, 2,3-dimethylbutane, isohexane, 3-methylpentane, n-hexane and n-heptane.

The combination of alcohol and alkane is effective for removing a wide spectrum of contaminants from the substrate. Since the lower molecular weight alcohols are good polar solvents, they are generally better at dissolving ionic contaminants such as inorganic salts, fingerprints, and the like. Alkanes, being non-polar, provide good solvency for covalently bonded materials such as paraffinic and naphthenic oils or greases and particularly silicone oils which are often the source for coating resist spots. Thus, the combination of two different types of solvents, the alcohol and the alkane, can remove a broader spectrum of contaminants than the use of a single solvent type. The alcohol and alkane mixture, particularly isopropanol and hexane, is effective at removing silicone contaminants such as polydimethylsiloxane from the substrate. In contrast, the conventional mild acid and alkaline aqueous cleaners are not effective at removing the silicone contaminants which are a major contributor to the dip coating defect known as resist spots. Although the efficacy of alkaline cleaners to remove silicones improves with increasing pH, the resulting level of surface destruction via etching is unacceptable for aluminum photoreceptor substrates.

The mixture of the alcohol and the alkane may be an azeotropic solution to facilitate purification of the mixture via distillation to remove contaminants. After purification, the alcohol and alkane mixture may be recycled for further use as a cleaning solvent. An example of an azeotropic mixture is isopropanol and hexane.

In embodiments of the present invention, the substrate is cleaned prior to dip coating by dipping the substrate into and raising the substrate from a cleaning solvent compatible with the coating solution of the first coating station. The term "compatible" means that the cleaning solvent, if present on the substrate during dipping of the substrate into the coating solution, will not detrimentally affect the coated layer, either its physical properties such as uniformity and thickness, or its performance such as electrical characteristics in the resulting photoreceptor. The term "compatible" is intended to refer to the residual amount of the cleaning solvent that may be present on the substrate upon its withdrawal from the cleaning solvent. It is recognized that the exact amount of residual cleaning solvent depends for example on the take-up speed of the substrate from the cleaning solvent, the evaporation rate of the specific cleaning solvent, and the use of a drying step. However, to determine the effect of the cleaning solvent on the resulting coated layer, the amount of the cleaning solvent in question is a smaller amount such as that found in a bead at the bottom edge of the substrate and perhaps elsewhere on substrate surface, rather than a larger amount such as by mixing copious amounts of the cleaning solvent with the coating solution.

The compatible cleaning solvent may have for example the same or similar composition as the solvent of the coating solution. The term "similar" means that the cleaning solvent and the coating solvent belong to the same chemical category. For example, the cleaning solvent and the coating solvent may be both alcohols but different ones. Suitable compatible cleaning solvents include the solvents disclosed herein either individually or in a mixture. The alcohol and alkane mixture disclosed herein may be a cleaning solvent compatible with the coating solution in embodiments of the present invention. For example, it is believed that residual amounts of the azeotropic mixture of the isopropanol and hexane on the substrate will not adversely affect the coated layer by contaminating the coating solution.

A cleaning solvent compatible with the coating solution renders optional the step of blowing air against the substrate to increase evaporation of any cleaning solvent present on the substrate prior to dipping the substrate into the coating solution. This is because residual amounts of the compatible cleaning solvent does not adversely affect the coated layer. Thus, the cleaned substrate with the residual cleaning solvent may be moved to the first dip coating vessel and dipped into the coating solution. However, when the particular alcohol and alkane mixture is not compatible with the coating solution, it is preferred to blow air against the substrate to increase evaporation of any cleaning solvent present on the substrate, thereby removing a substantial portion, perhaps all, of the residual cleaning solvent, prior to the entry of the substrate into the coating solution.

The discussion below is applicable to substrate cleaning with the compatible cleaning solvent and with the alcohol and alkane mixture. The instant cleaning operation of dipping and withdrawing the substrate from the cleaning solvent is simple, cost effective, and readily permits incorporation of the cleaning operation into an existing coating line by merely adding for example an additional vessel for the cleaning solvent adjacent to the first dip coating vessel.

Cleaning may be enhanced by the use of one or more of the following: ultrasonic agitation, multiple dipping and withdrawal from the cleaning solvent, cleaning solvent recirculation, filtration, and distillation. The steps of recirculation, filtration, and distillation remove contaminants from the cleaning solvent thereby increasing its efficacy. The substrate stays in the cleaning solvent to effect dissolution of contaminants on the substrate for a time period ranging for example from about 10 seconds to about 3 minutes, and preferably from about 30 seconds to about 1 minute.

Preferably, the substrate remains chucked by the same chucking apparatus as the substrate undergoes cleaning and the first dip coating procedure, as well as subsequent dip coating steps. This eliminates extra substrate handling steps since the substrate is not unchucked and then rechucked during the various photoreceptor fabrication steps. A representative chucking apparatus is disclosed in Mistrater et al., U.S. Pat. No. 5,320,364, the disclosure of which is totally incorporated by reference.

The substrate cleaning, the first dip coating procedure, as well as subsequent dip coating steps, may be carried out in a clean air environment where the cleanness degree is preferably not higher than 100. Spots may result on the photoreceptor if the cleanness degree exceeds 100. The cleanness degree of the clean air is expressed by the number of dust grains contained in a $ft^3$ and they are measured by a dust counter such as Model KC-01B manufactured by Rion Company. The number of the dust grains can be measured by specifying the grain sizes, namely, not smaller than 0.1 micron, not smaller than 0.3 micron and not smaller than 0.5 micron. In the present invention, the cleanness degree is measured by the numbers of the dust grains each having the grain size not smaller than 0.5 micron.

The first dip coating solution, which the cleaned substrate is dipped into, preferably deposits one of the following photoreceptor layers: a charge blocking layer (also known in the art as an undercoat layer), a charge generating layer, and a charge transport layer. In preferred embodiments, the instant method has at least the following steps in the specified order: cleaning of the substrate in the cleaning solvent; optional blowing of air against the substrate to increase evaporation of the residual cleaning solvent on the substrate; dip coating to form a charge blocking layer on the substrate; dip coating to form a charge generating layer on the blocking layer; and dip coating to form a charge transport layer on the charge generating layer; drying of the coated layers at any suitable temperature ranging for example from about 100 to about 130 degrees Centigrade.

The substrate can be formulated entirely of an electrically conductive material, or it can be an insulating material having an electrically conductive surface. The substrate can be opaque or substantially transparent and can comprise numerous suitable materials having the desired mechanical properties. The entire substrate can comprise the same material as that in the electrically conductive surface or the electrically conductive surface can merely be a coating on the substrate. Any suitable electrically conductive material can be employed. Typical electrically conductive materials include metals like copper, brass, nickel, zinc, chromium, stainless steel; and conductive plastics and rubbers, aluminum, semitransparent aluminum, steel, cadmium, titanium, silver, gold, paper rendered conductive by the inclusion of a suitable material therein or through conditioning in a humid atmosphere to ensure the presence of sufficient water content to render the material conductive, indium, tin, metal oxides, including tin oxide and indium tin oxide, and the like. The substrate layer can vary in thickness over substantially wide ranges depending on the desired use of the photoconductive member. Generally, the conductive layer ranges in thickness of from about 50 Angstroms to 10 centimeters, although the thickness can be outside of this range. When a flexible electrophotographic imaging member is desired, the substrate thickness typically is from about 0.015 mm to about 0.15 mm. The substrate can be fabricated from any other conventional material, including organic and inorganic materials. Typical substrate materials include insulating non-conducting materials such as various resins known for this purpose including polycarbonates, polyamides, polyurethanes, paper, glass, plastic, polyesters such as MYLAR® (available from DuPont) or MELINEX 447® (available from ICI Americas, Inc.), and the like. If desired, a conductive substrate can be coated onto an insulating material. In addition, the substrate can comprise a metallized plastic, such as titanized or aluminized MYLAR®. The coated or uncoated substrate can be flexible or rigid, and can have any number of configurations such as a hollow cylinder, an endless flexible belt, and the like.

A suitable charge blocking layer is now discussed. Electron blocking layers for positively charged photoreceptors allow holes from the imaging surface of the photoreceptor to migrate toward the conductive layer. For negatively charged photoreceptors, any suitable hole blocking layer capable of forming a barrier to prevent hole injection from the conductive layer to the opposite photoconductive layer may be utilized. The hole blocking layer may include polymers such as polyvinylbutyral, epoxy resins, polyesters, polysiloxanes, polyamides, polyurethanes and the like, or may be nitrogen containing siloxanes or nitrogen containing titanium compounds such as trimethoxysilyl propylene diamine, hydrolyzed trimethoxysilyl propyl ethylene diamine, N-beta-(aminoethyl) gamma-amino-propyl trimethoxy silane, isopropyl 4-aminobenzene sulfonyl, di(dodecylbenzene sulfonyl) titanate, isopropyl di(4-aminobenzoyl)isostearoyl titanate, isopropyl tri(N-ethylaminoethylamino)titanate, isopropyl trianthranil titanate, isopropyl tri(N,N-dimethylethylamino)titanate, titanium-4-amino benzene sulfonate oxyacetate, titanium 4-aminobenzoate isostearate oxyacetate, $[H_2N(CH_2)_4]CH_3Si(OCH_3)_2$, gamma-aminobutyl) methyl diethoxysilane, and $[H_2N(CH_2)_3]CH_3Si(OCH_3)_2$, (gamma-aminopropyl)-methyl diethoxysilane, as disclosed in U.S. Pat. Nos. 4,338,387, 4,286,033 and 4,291,110. Other suitable hole blocking layer polymer compositions are also described in U.S. Pat. No. 5,244,762. These include vinyl hydroxyl ester and vinyl hydroxy amide polymers wherein the hydroxyl groups have been partially modified to benzoate and acetate esters which modified polymers are then blended with other unmodified vinyl hydroxy ester and amide unmodified polymers. An example of such a blend is the 30 mole percent benzoate ester of poly(2-hydroxyethyl methacrylate) blended with the parent polymer poly(2-hydroxyethyl methacrylate). A preferred charge blocking layer or undercoat layer is nylon 8 or zirconyl-silane.

The coating solution may comprise components for the charge transport layer and/or the charge generating layer, such components and amounts thereof being illustrated for instance in U.S. Pat. No. 4,265,990, U.S. Pat. No. 4,390,611, U.S. Pat. No. 4,551,404, U.S. Pat. No. 4,588,667, U.S. Pat. No. 4,596,754, and U.S. Pat. No. 4,797,337, the disclosures of which are totally incorporated by reference. In embodiments, the coating solution may be formed by dispersing a charge generating material selected from azo pigments such as Sudan Red, Dian Blue, Janus Green B, and the like; quinone pigments such as Algol Yellow, Pyrene Quinone, Indanthrene Brilliant Violet RRP, and the like; quinocyanine pigments; perylene pigments; indigo pigments such as indigo, thioindigo, and the like; bisbenzoimidazole pigments such as Indofast Orange toner, and the like; phthalocyanine pigments such as copper phthalocyanine, aluminochloro-phthalocyanine, and the like; quinacridone pigments; or azulene compounds in a binder resin such as polyester, polystyrene, polyvinyl butyral, polyvinyl pyrrolidone, methyl cellulose, polyacrylates, cellulose esters, and the like. In embodiments, the coating solution may be formed by dissolving a charge transport material selected from compounds having in the main chain or the side chain a polycyclic aromatic ring such as anthracene, pyrene, phenanthrene, coronene, and the like, or a nitrogen-containing hetero ring such as indole, carbazole, oxazole, isoxazole, thiazole, imidazole, pyrazole, oxadiazole, pyrazoline, thiadiazole, triazole, and the like, and hydrazone compounds in a resin having a film-forming property. Such resins may include polycarbonate, polymethacrylates, polyarylate, polystyrene, polyester, polysulfone, styrene-acrylonitrile copolymer, styrene-methyl methacrylate copolymer, and the like.

The organic solvent suitable for preparing a coating solution (for any of the photoreceptor layers discussed herein) include the following illustrative examples: alcohols such as methanol, ethanol, and isopropanol, as well as others described herein; ketones such as acetone, methylethyl ketone and cyclohexanone; amides such as N,N-dimethyl formamide and N,N-dimethyl acetamide; sulfoxides such as dimethyl sulfoxide; ethers such as tetrahydrofuran, dioxane, and ethylene glycol monomethyl ether; esters such as methyl acetate and ethyl acetate; aliphatic halogenohydrocarbons such as chloroform, methylene chloride, dichloroethylene, carbon tetrachloride and trichloroethylene; or aromatic compounds such as benzene, toluene, xylene, ligroin, monochlorobenzene, and dichlorobenzene.

The invention will now be described in detail with respect to specific preferred embodiments thereof, it being understood that these examples are intended to be illustrative only and the invention is not intended to be limited to the materials, conditions or process parameters recited herein. All percentages and parts are by weight unless otherwise indicated.

EXAMPLE 1

Approximately 300 liters of solvent, containing 70% isopropanol and 30% hexane, were charged to a cleaning tank. The tank is equipped with an overflow weir and an input manifold along the bottom of the tank for recirculating the cleaning solvent. An inline 0.5 micron filter was used to remove undissolved particulates from the solvent. An EP rated pump was used to recirculate the solvent at a rate of 20–40 liters per minute. In order to avoid an undesirable buildup of dissolved oils in the cleaning solvent during long term cleaning operations a continuous input/output distillation system can be used to purify the cleaning solvent. Nickel electroformed substrates were loaded onto the conveying line using a chucking apparatus. The substrates were moved to the cleaning station and immersed in the cleaning solvent for a time of 5 min. During this immersion step ultrasonic agitation was used to assist in dislodging particulates and residual oils. The ultrasonic generators were cycled on and for 30 sec during the immersion cleaning step while the substrates were vertically oscillated, over a 5 cm span at a rate of 5 cm/sec, to avoid ultrasonic burning of the substrate surface. Following the 5 min. immersion, the substrates were withdrawn from the cleaning solvent and allowed to drain over the cleaning tank for an additional 5 min. After air drying, the substrates were moved to an air blowoff station to remove any residual solvent remaining on the substrate.

The substrates were next transported horizontally to the undercoat layer (UCL) coating station. Approximately 300 liters of UCL solution, containing about 9% by weight nylon 8 dissolved in a solution of methanol/butanol/water at a weight ratio of 6/4/1, respectively, was prepared for the UCL coating station. The chucked substrates were vertically immersed into the UCL coating solution for a period of less than 1 min., then slowly withdrawn at a rate of 200 mm/min. to achieve a coating thickness of about 1.5 microns.

Following the UCL coating the substrates were dip coated, in a similar fashion, with a layer of charge generating material having a wet thickness of about 0.2 micron. The charge generating material coating solution comprised: about 2% by weight hydroxy gallium phthalocyanine; about 3% by weight terpolymer of vinyl acetate, vinyl chloride, and maleic acid; and about 95% by weight butyl acetate A final coating of a charge transport layer coating solution was similarly applied. This coating was comprised of the following composition: 10% by weight N,N'-diphenyl-N,N'-bis(3-methylphenyl)-[1,1'-biphenyl]-4,4'diamine; 14% by weight poly(4,4'-diphenyl-1,1'-cyclohexane) carbonate (400 molecular weight); 57% by weight tetrahydrofuran; and 19% by weight monochlorobenzene. During this dip coating cycle the substrates were immersed at a speed of about 600 mm/min., and then after a 10 seconds pause were raised completely out of the coating solution at a constant take-up speed of about 120 mm/min. to achieve a coating thickness of about 24 microns. After withdrawal of the substrates from the final coating solution, there was a second pause of about 180 seconds where the cylinders were motionless to promote air drying of the coating to a tacky film. The cylinders were conveyed to a drying oven where the cylinders were subjected to a temperature of about 120 degrees Centigrade for about 55 minutes. Upon visual inspection of the coated, dried substrates, the coating on each substrate was found to be uniform which indicated the absence of particulate debris which would have disturbed the coating uniformity. Thus, the substrate cleaning operation was effective at removing particulate debris from the substrate surface prior to coating.

EXAMPLE 2

A cleaning solution of methanol/butanol/water, at a weight ratio of 6/4/1, respectively, was prepared for the precoat cleaning station. The substrates were cleaned and coated as described in Example 1 with the exception of the post clean air blowoff which was not required because of the compatibility of the cleaning solvent to the UCL coating solvent. Both the cleaning solution and the UCL solvent were methanol/butanol/water, at a weight ratio of 6/4/1, respectively. Also, in this case a distillation system was not used to purify the solvent. Instead the solvent was used to a predetermined end-of-life and discarded. Upon visual inspection of the coated, dried substrates, the coating on each substrate was found to be uniform which indicated the absence of particulate debris which would have disturbed the coating uniformity. Thus, the substrate cleaning operation was effective at removing particulate debris from the substrate surface prior to coating.

Other modifications of the present invention may occur to those skilled in the art based upon a reading of the present disclosure and these modifications are intended to be included within the scope of the present invention.

What is claimed is:

1. A method for depositing layered material onto a substrate including a layer formed from a coating solution having a coating solvent, wherein the method comprises:

(a) cleaning the substrate by dipping the substrate into and raising the substrate from a cleaning solvent free of a halogenated solvent comprising an alcohol and an alkane; and (b) dipping the substrate subsequent to (a) into and raising the substrate from the coating solution, thereby depositing the layer on the substrate, wherein the layer is a charge blocking layer or a photosensitive layer of a photoreceptor.

2. The method of claim 1, further comprising blowing air against the substrate between (a) and (b) to increase evaporation of any cleaning solvent present on the substrate.

3. The method of claim 1, wherein the alcohol and the alkane are an azeotropic mixture.

4. The method of claim 1, wherein the alcohol is isopropanol and the alkane is hexane.

5. The method of claim 1, wherein the cleaning solvent consists essentially of the alcohol and the alkane.

6. The method of claim 1, wherein the cleaning solvent is compatible with the coating solution and any any cleaning solvent present on the substrate upon the dipping of the substrate into the coating solution fails to detrimentally affect the layer.

7. The method of claim 1, wherein the cleaning solvent and the coating solvent have the same composition.

8. The method of claim 1, wherein the cleaning solvent and the coating solvent are the same or different alcohol.

* * * * *